US006598514B2

(12) United States Patent
Leggi

(10) Patent No.: US 6,598,514 B2
(45) Date of Patent: Jul. 29, 2003

(54) KIOSK FOR PREPARING PORTIONS OF ITALIAN-STYLE PASTA

(75) Inventor: Aurelio Leggi, Piacenza (IT)

(73) Assignee: Techfood S.N.C. Di Iori E Castagnetti, Reggio Emilia (IT)

( * ) Notice: Subject to any disclaimer, the term of this patent is extended or adjusted under 35 U.S.C. 154(b) by 0 days.

(21) Appl. No.: 10/004,947

(22) Filed: Dec. 4, 2001

(65) Prior Publication Data

US 2002/0092426 A1 Jul. 18, 2002

(30) Foreign Application Priority Data

Dec. 14, 2000 (IT) ..... MI2000A2711

(51) Int. Cl.[7] ..... A47J 37/07; B62K 17/00

(52) U.S. Cl. ..... 99/339; 99/340; 99/357; 99/403; 99/484; 126/276

(58) Field of Search ..... 99/339, 340, 357, 99/330, 403, 448, 484; 126/276, 37 R, 37 B; 312/236, 237, 281, 282; 219/429, 433

(56) References Cited

U.S. PATENT DOCUMENTS 1,513,357 A * 10/1924 Webber ..... 126/268
2,225,176 A * 12/1940 Lewis et al. ..... 99/372
2,949,525 A * 8/1960 Dunn ..... 219/392
3,289,664 A * 12/1966 Hewitt ..... 126/37 R
3,915,529 A 10/1975 Bernier ..... 312/237
3,958,503 A 5/1976 Moore ..... 99/327
4,803,917 A 2/1989 Barbieri ..... 99/356
5,365,831 A 11/1994 Kuhlman ..... 99/355
6,192,791 B1 * 2/2001 Baker et al. ..... 99/403
6,349,715 B1 * 2/2002 McBroom ..... 126/276

FOREIGN PATENT DOCUMENTS

| | | |
|---|---|---|
| DE | 4444372 | 6/1996 |
| DE | 19510231 | 9/1996 |
| WO | 9928147 | 6/1999 |

* cited by examiner

*Primary Examiner*—Reginald L. Alexander
(74) *Attorney, Agent, or Firm*—Steinberg & Raskin, P.C.

(57) ABSTRACT

A kiosk (10) that enables pasta portions of the type forming the classical Italian first course to be prepared, the kiosk (10) including an automatic pasta cooking machine (18); a cooking hob (20) for amalgamating within a suitable container, by heating accompanied by mixing, the required sauces or condiments with the pasta previously cooked in the pasta cooking machine; and a heating element (22) for heating the sauces or condiments and/or for maintaining them hot.

17 Claims, 4 Drawing Sheets

KIOSK FOR PREPARING PORTIONS OF ITALIAN-STYLE PASTA

FIELD OF THE INVENTION

The present invention relates to a kiosk for preparing portions of pasta of the type forming the classical Italian first course.

BACKGROUND OF THE INVENTION

Most of the world's urban landscape embraces fixed or movable kiosks selling drinks, coffee, ice-cream, sandwiches, toasted sandwiches, "bruschettas" (seasoned bread slices), sausages, "piadinas" (unleavened bread pieces), pizzas or crepes (in recent times even outside France) which are prepared on demand and sold hot. Movable kiosks of this type are also used at fairs, festivals, sporting events and the like, to provide the crowd not only with traditional comforts (coffee, hot or cold drinks in general) but also with a snack or light meal based on sandwiches, toasted sandwiches, bruschettas, piadinas, pizzas, sausages or crepes (by their very nature, such kiosks are unable to offer more).

The present applicant has noted that many people who at mealtimes during such occasions have to be content with the type of food provided by the aforesaid kiosks, would in fact as an alternative prefer a plate of variously flavoured hot pasta (i.e. the classical Italian first pasta-based course), even if eaten while standing.

However nobody has as yet attempted to offer such a service because the traditional kiosks are not equipped for this purpose.

OBJECTS AND SUMMARY OF THE INVENTION

The object of the present invention is therefore to make it possible to provide for, and hence satisfy, this potential market requirement. Said object is attained by the kiosk of the present invention, characterised by comprising:

an automatic pasta cooking machine;

a cooking hob for amalgamating within a suitable container, by heating accompanied by mixing, the required sauces or condiments with the pasta previously cooked in the pasta cooking machine;

means for heating the sauces or condiments and/or for maintaining them hot.

The pasta cooking machine can for example be that produced by the proprietor of the present patent application and known by brand name PASTALAND, whereas the cooking hob can conveniently be of the glass ceramic plate type.

The said means for maintaining sauces or condiments hot can comprise sets of containers heated by electrical resistance heaters or a gas burner fed with mains or cylinder gas.

The kiosk will also conveniently comprise a retractable wash basin, a refrigerator and a storage cupboard.

The kiosk can be of fixed type, i.e. intended to remain permanently in a determined place, or of movable type so that it can be moved to whereever required. In this latter case it is provided with wheels to enable it to be moved by pushing or pulling.

The kiosk of the present invention can even be made self-propelled, and form in practice a vehicle provided with a motor (internal combustion engine or storage battery-powered electric motor) with relative transmission to drive two of the kiosk wheels.

The kiosk of the invention can even be provided with solar panels (for example positioned on a roof with which it can be provided) for charging the storage batteries, which can then supply electrical energy for example for heating water for various uses or for preheating the water used in the pasta cooking machine, or for lighting the kiosk and/or for operating a possible cash register and the so-called POS devices for payment by bank credit or debit card.

BRIEF DESCRIPTION OF THE DRAWINGS

The invention will be more apparent from the ensuing description of one embodiment thereof given by way of example. In this description, reference is made to the accompanying drawings, in which.

DETAILED DESCRIPTION OF THE INVENTION

Figure 1:
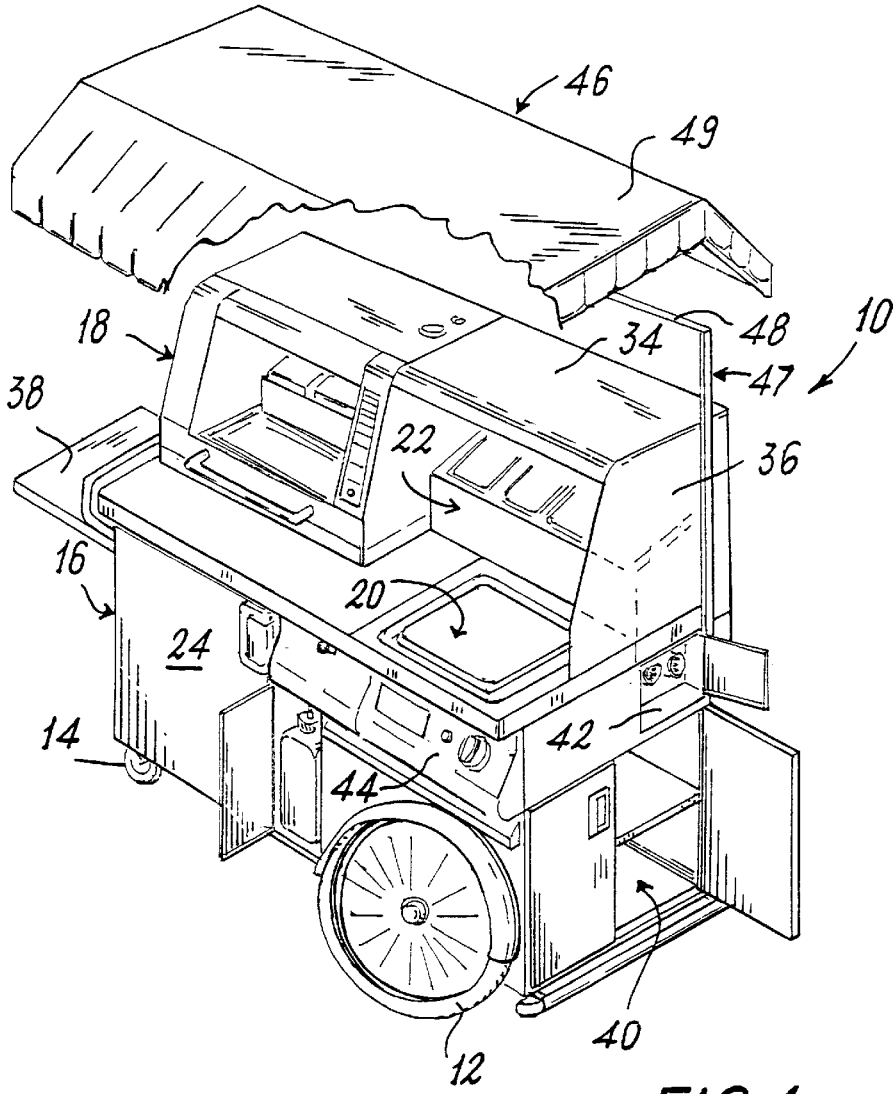
FIG. 1 is a perspective view of the kiosk of the present invention.

As can be seen from the figures, the kiosk 10 is of the type movable by pushing or pulling, it being provided with wheels, and specifically with two large-diameter coaxial wheels 12 and two small-diameter castor wheels 14 enabling the kiosk to be orientated in the required direction. The kiosk also comprises a bench-type structure 16 supported by the axles of the wheels 12 and 14 and on which an automatic pasta cooking machine 18 is fixed (for example that constructed by the present applicant and known by the brand name PASTALAND). The pasta cooking machine 18 is known to be of the type comprising one or more perforated bowls for containing the pasta to be cooked. The perforated bowl or bowls can, by being rotated, assume (in the second case independently) two positions, namely a first position in which they are immersed in a cooking vessel containing water heatable by armoured electrical resistance heaters and/or gas-fed burners, and a second position which is assumed automatically after a predetermined time and enables the pasta, now properly cooked, to fall into an underlying collection container in which it can be held until required.

Figure 7:
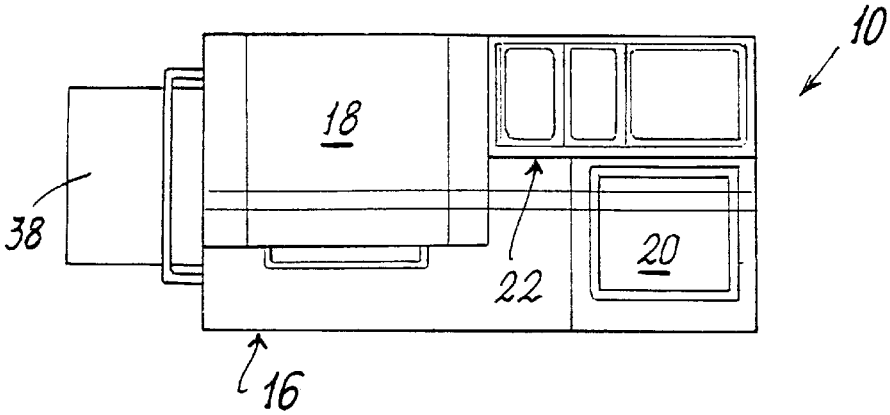
FIG. 7 is a horizontal section therethrough on the line 7—7 of FIG. 3.

As can be seen from FIGS. 1 and 7, the bench 16 incorporates a cooking hob 20 which in this specific case comprises a glass ceramic plate heatable by conventional underlying infrared electrical resistance heaters (not shown). It should however be noted that the cooking hob can be of different type, for example consisting of a conventional electrical hotplate or even a gas ring if a gas supply is available (from the gas main or from a cylinder contained in the kiosk 10 or positioned external to it).

Figure 2:
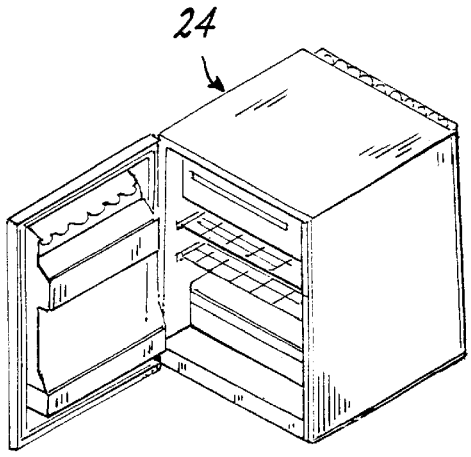
FIG. 2 is a perspective view only of the refrigerator, forming part of the kiosk of FIG. 1.

On the bench 16, to the side of the pasta cooking machine 18 and adjacent to the cooking hob 20, there are provided means (indicated overall by 22) for heating and maintaining hot the sauces or condiments already prepared for flavouring the pasta. The heating means can also be used to keep other foods or bread hot. In the illustrated example, these heating means 22 consist of a series of stainless steel containers (three in this particular case, of which two have the same dimensions whereas the third is of larger dimensions) heatable for example by electrical resistance heaters or by a gas burner (the gas as already stated originating from the gas main if possible, or from a cylinder contained in the bench 16 or externally). If the containers 22 are heated by a gas burner, a device for recovering the thermal energy contained in the burnt gas can be provided, this recovered thermal energy enabling water to be heated for various uses, or enabling the water for cooking the pasta used in the pasta cooking machine 18 to be preheated. In the illustrated example, the set of containers 22 is protected upperly by a cover or small hood 34 connected on one side to the top of the adjacent pasta cooking machine 18, its other side terminating against a lateral wall 36, this latter and the cover 34 preferably being of transparent plastic material. The bench 16 also incorporates a small refrigerator 24 (more visible in FIG. 2).

Figure 4:
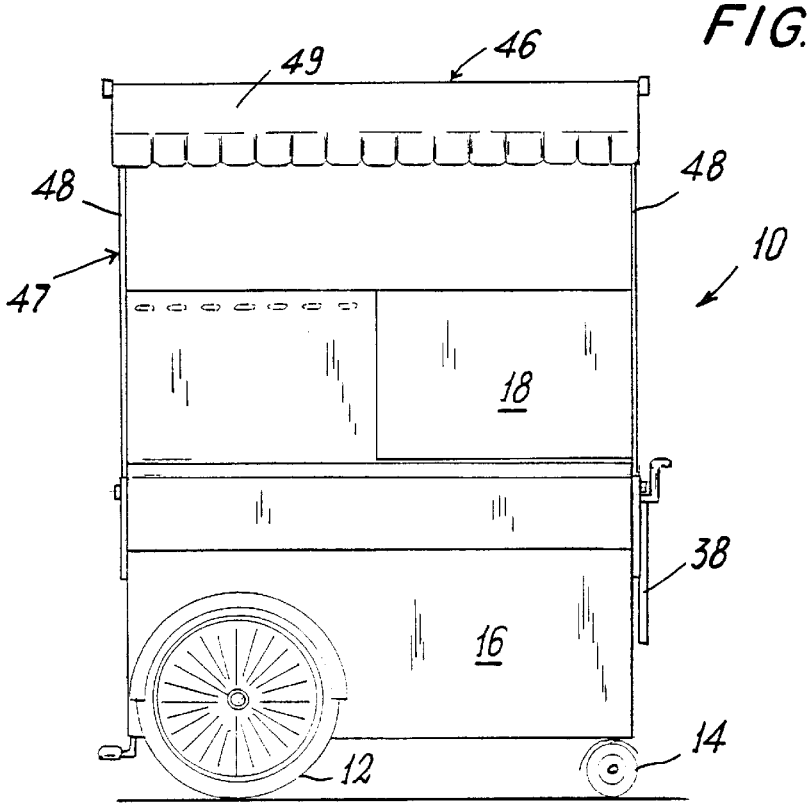
FIG. 4 is a rear elevation thereof.
Figure 5:
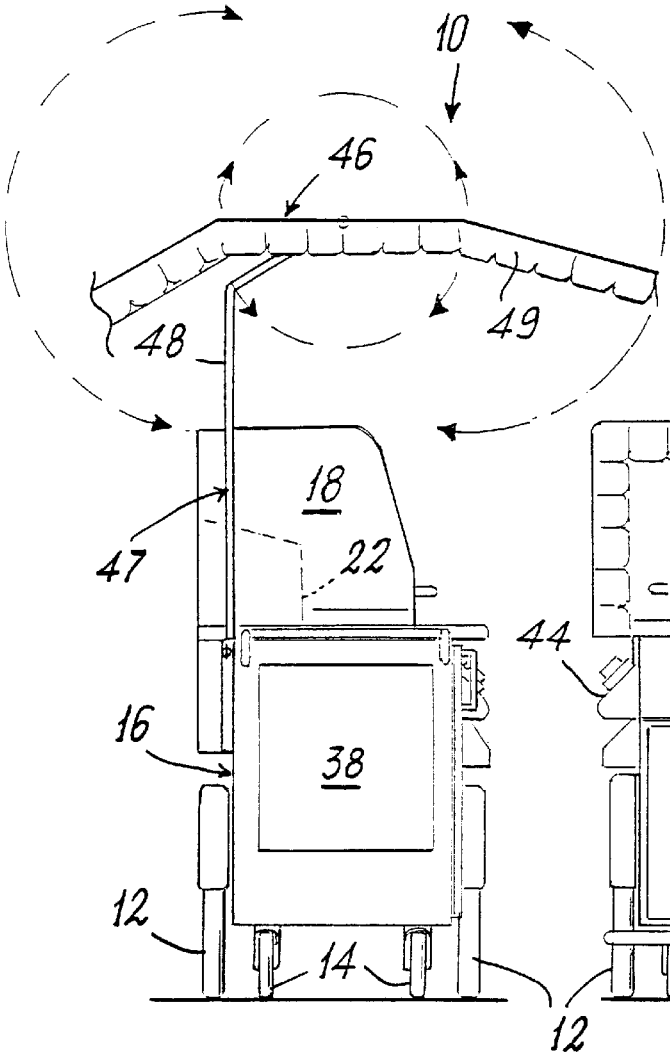
FIG. 5 is a side elevation seen from the left of FIG. 1.

The kiosk 10 also comprises a foldable support shelf 38 (shown folded away in FIGS. 4 and 5) having various uses (for example as a resting shelf for customers, for depositing thereon the pasta portions ready to be consumed, or for a cash register). Instead of being foldable, the shelf 38 can be of the type applicable by conventional insert brackets.

The kiosk 10 is also provided with a storage cupboard 40 (FIGS. 1 and 6) which can be useful to the kiosk operator, in particular for storing the overall to be worn while working, or for storing miscellaneous objects or implements (for example the plates or cups for serving the pasta).

Figure 3:
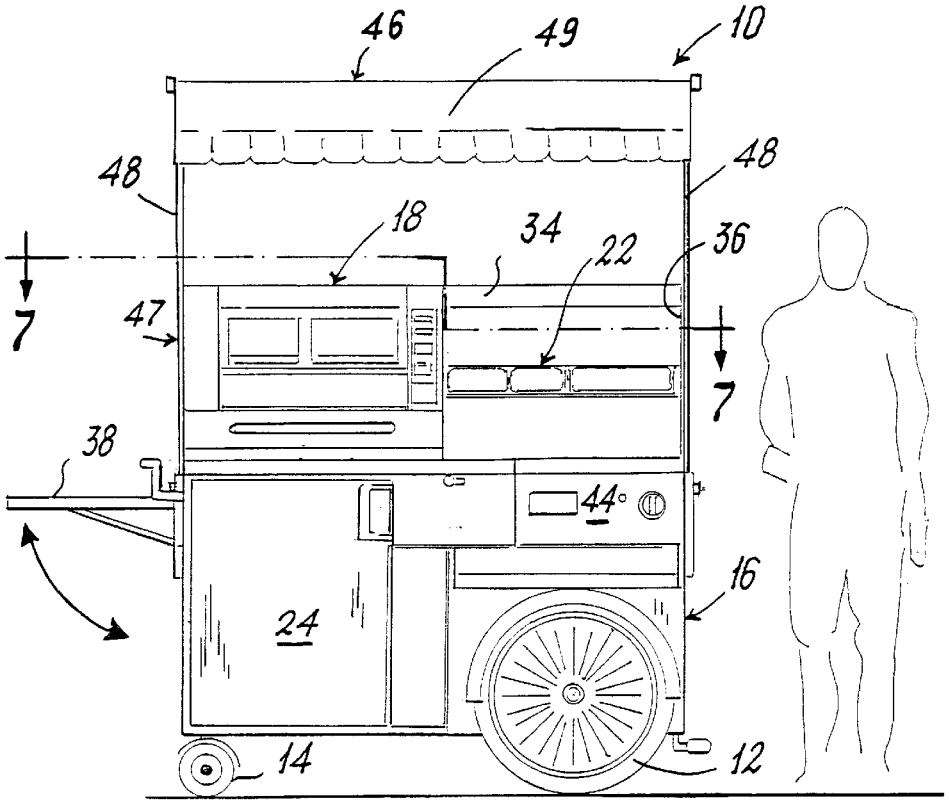
FIG. 3 is a front elevation of the kiosk of FIG. 1, this figure showing the outline of a man to give an idea of the size of the kiosk.

In the bench 16 there is provided above the cupboard 40 (FIGS. 1 and 3) a recess closed by a relative door and containing the connectors for connection to the electric mains or to an electrical generator unit, and/or miscellaneous switches.

In the front part 44 of the kiosk 10, just below the cooking hob 20 there are provided the controls for the cooking hob 20 and heating means 22, together with any other controls for the operation of the kiosk 10, including a possible control display unit.

Figure 6:
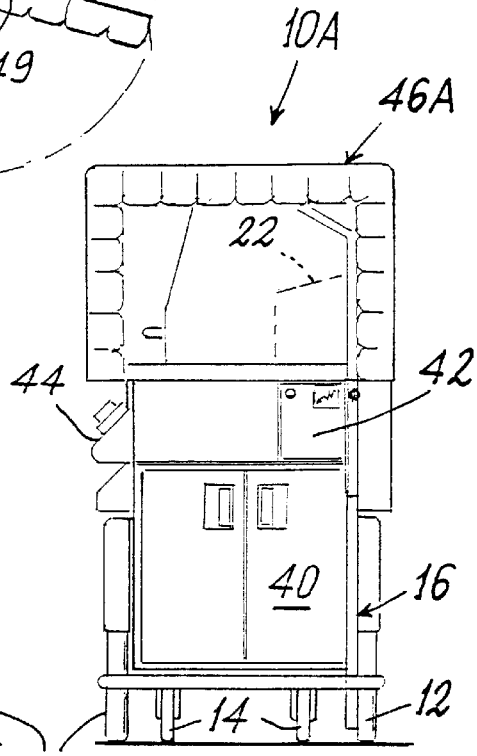
FIG. 6 is a side elevation seen from the right of FIG. 1.

The kiosk 10 is completed (if required) by a protection cover 46 (which however can also be absent) consisting in the illustrated example of a lightweight metal structure 47 (of which two lowerable uprights 48 are visible) covered by fabric 49. The metal structure 47 is such as to enable the cover 46 to be folded down (as indicated in FIG. 6, in which the kiosk is shown in its non-working condition and indicated by 10A, and the folded cover by 46A). As already stated the kiosk 10 can be conveniently provided with a direct current motor powered by storage batteries (both the motor and the storage batteries being contained in the bench 16), the motor driving via a suitable transmission the larger wheels 12 of the kiosk, which is hence self-propelled. Although the kiosk 10 shown in the Figures is provided with four wheels (12, 14), the kiosk of the present invention can also be without wheels, or can be provided with three wheels instead of four, depending on specific requirements. In the first case, means can be provided for fixing the kiosk to the ground. Likewise, the foldable cover 46 can also be absent or be of the non-foldable type, or foldable in a manner different from that of FIG. 6. In the variant of the kiosk of the present invention illustrated partially in FIG. 8 and indicated by 110, instead of the storage cupboard (44 in FIG. 1) there are provided an additional upper shelf 150 (for example of the type which can be folded away or be applied by conventional insert brackets) and a lower shelf 152 (also of the foldable type or applicable by insert brackets). The upper shelf 150 can for example hold a cash register 154, whereas the lower shelf 152 presents a through circular hole 166 of suitable diameter provided with a downwardly projecting lower rim to which there can be applied (for example by an elastic band) the mouth of a refuse bag 156 which rests directly on the ground.

In the specific illustrated example there are also provided two lateral doors 158 and 160 which can be closed once the shelves 150 and 152 have been removed or folded away, and which can also be used for supporting the shelves 150 and 152.

Figure 8:
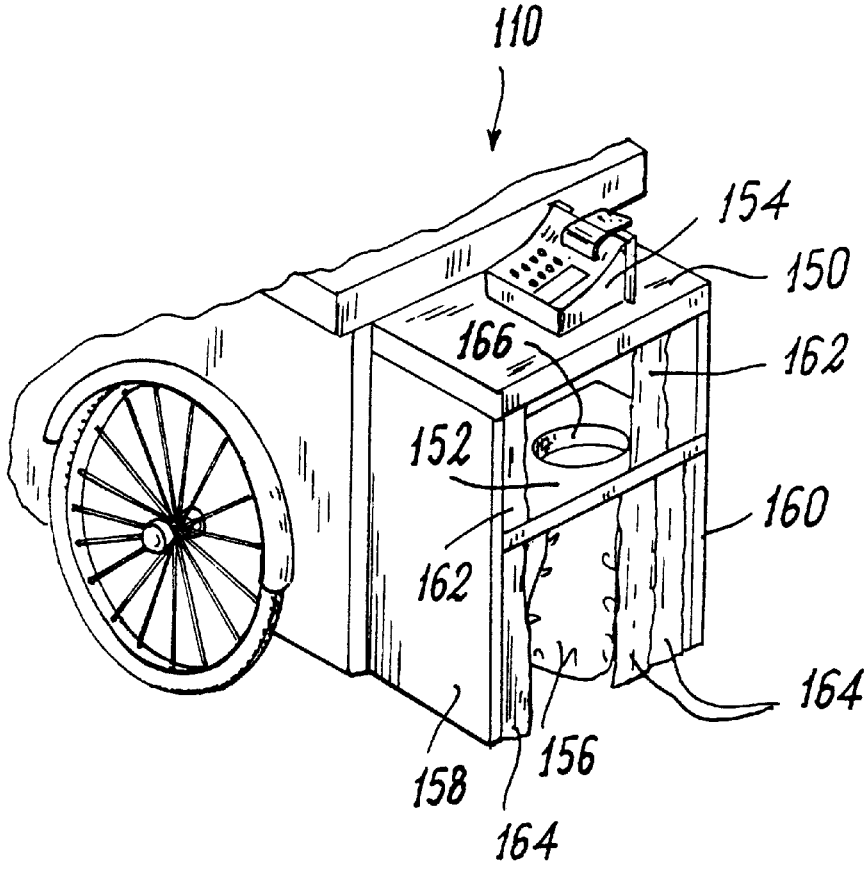
FIG. 8 is a partial perspective view of a variant of the kiosk of FIG. 1.

The part which remains open between the two lateral doors 158 and 160 can be conveniently closed by curtains, in particular two sets of curtains in the form of vertical strips of flexible plastic material, a first set externally closing the space between the upper shelf 150 and lower shelf 152 (only some of these curtains, indicated by 162, are shown in FIG. 8) and a second set of curtains externally closing the space between the lower shelf 152 and the ground (only some of these curtains, indicated by 164, are shown). However, the lateral doors 158 and 160 could clearly be replaced by curtains of the aforesaid type.

The manner in which the kiosk 10 can be used in practice will now be briefly described.

After setting up the kiosk 10 (in the sense of making it operational by satisfying the water requirements, in particular by filling the cooking vessel of the pasta cooking machine and filling the clean water container 30), and making the necessary connections to the electricity mains or to an electrical generator unit, and possibly to the gas main or to a gas cylinder, the relative quantity of pasta (of the desired format) to be cooked is placed in the perforated bowl or bowls of the pasta cooking machine 18 and the machine is activated to cook the pasta quantity/quantities. When cooking is complete, the pasta cooking machine 18 automatically discharges the cooked pasta quantities into an underlying container by overturning the relative perforated bowl. If suitable, this container can be positioned directly on the cooking hob 20, or the pasta contained therein can be transferred (possibly later) by the kiosk operator into another container suitable for positioning on the cooking hob 20. At this point the required sauce or condiment is poured onto the pasta, the combination then being amalgamated by mixing and by virtue of the heat emitted by the cooking hob. The pasta portion or portions are now ready to be served, for example by pouring individual flavoured pasta portions into suitable plates or containers.

I claim:

1. A kiosk (10) for preparing pasta portions of the type forming the classical Italian first course, comprising:

a frame structure:

an automatic pasta cooking machine (18) arranged in said frame structure;

a cooking hob (20) arranged in said frame structure for amalgamating within a suitable container, by heating accompanied by mixing, the required sauces or condiments with the pasta previously cooked in the pasta cooking machine;

means (22) for heating the sauces or condiments and/or for maintaining them hot arranged in said frame structure.

2. A kiosk (10) as claimed in claim 1, wherein the means for heating sauces or condiments and/or for maintaining them hot comprise a series of containers (22) heated by electrical resistance heaters.

3. A kiosk (10) as claimed in claim 1, wherein the means for heating sauces or condiments and/or for maintaining them hot comprise a series of containers (22) heated by a gas burner.

4. A kiosk (10) as claimed in claim 1, wherein a refrigerator (24) is provided.

5. A kiosk (10) as claimed in claim 1, wherein a storage cupboard (40) is provided.

6. A kiosk (10; 110) as claimed in claim 1, comprising an additional shelf (38; 150) which can be folded away or applied by insert brackets.

7. A kiosk (110) as claimed in claim 6, wherein below the additional shelf (150) there is provided a lower additional shelf (152) spaced from the first (150) and from the ground, in which lower shelf (152) there is provided a through hole (166) with a downwardly projecting lower rim to which a refuse bag can be applied.

8. A kiosk (110) as claimed in claim 7, comprising two lateral doors (158, 160) which can be closed once the additional shelves (150, 152) have been removed or folded away.

9. A kiosk (110) as claimed in claim 7, wherein the open space between the shelves (150, 152) and the ground can be closed externally by strip curtains.

10. A kiosk as claimed in claim 1, wherein means are provided for fixing the kiosk to the ground.

11. A kiosk as claimed in claim 1, comprising wheels (12, 14) to facilitate its movement.

12. A kiosk as claimed in claim 11, wherein a motor and relative transmission are provided for driving two of the wheels, mounted on the same axle, to render the kiosk self-propelled.

13. A kiosk as claimed in claim 1, wherein solar panels are provided for charging electrical storage batteries or for heating water for various uses.

14. A kiosk as claimed in claim 13, wherein the solar panels preheat the water used in the pasta cooking machine.

15. A kiosk as claimed in claim 12, wherein the motor is of direct current type powered by storage batteries rechargeable by connection to the electrical mains.

16. A kiosk (10) as claimed in claim 1, wherein a cover (46) is provided.

17. A kiosk (10) as claimed in claim 16, wherein the cover (46) comprises a lightweight metal structure (47) covered by fabric (49).

* * * * *